United States Patent [19]

Yoshida et al.

[11] Patent Number: 4,517,715

[45] Date of Patent: May 21, 1985

[54] CHENILLE WOVEN OR KNITTED FABRIC AND PROCESS FOR PRODUCING THE SAME

[75] Inventors: Shusuke Yoshida; Tamotsu Nakajima, both of Otsu; Miyoshi Okamoto, Takatsuki, all of Japan

[73] Assignee: Toray Industries, Inc., Tokyo, Japan

[21] Appl. No.: 483,429

[22] Filed: Apr. 8, 1983

[30] Foreign Application Priority Data

| | | | |
|---|---|---|---|
| Apr. 13, 1982 | [JP] | Japan | 57-61410 |
| Jun. 25, 1982 | [JP] | Japan | 57-108330 |
| Sep. 9, 1982 | [JP] | Japan | 57-157112 |

[51] Int. Cl.[3] ..... D03D 27/18; D02G 3/42

[52] U.S. Cl. ..... 28/144; 28/163; 28/165; 28/169; 57/24; 57/203; 57/905; 139/393; 139/395

[58] Field of Search ..... 57/203, 210, 905, 24, 57/244, 248; 139/393–395; 28/144, 163, 165, 169

[56] References Cited

U.S. PATENT DOCUMENTS

| | | | |
|---|---|---|---|
| 3,715,878 | 2/1973 | Kim | 57/24 |
| 3,889,034 | 6/1975 | Lenards et al. | 28/144 X |
| 3,969,881 | 7/1976 | Boldrini | 57/24 |
| 4,122,658 | 10/1978 | Morioka et al. | 57/248 X |
| 4,127,696 | 11/1978 | Okamoto | 57/244 X |
| 4,350,006 | 9/1982 | Okamoto et al. | 57/248 X |

*Primary Examiner*—John Petrakes

*Attorney, Agent, or Firm*—Austin R. Miller

[57] ABSTRACT

An improved chenille woven or knitted fabric utilizing at least a chenille yarn composed of synthetic fibers, wherein raised fibers forming a raised fiber portion of the chenille yarn are composed of ultra-fine fibers having a fineness smaller than 0.9 denier and the rising angle $\alpha$ between the axis of the raised fibers and the longitudinal axis of the chenille yarn is not larger than 50°.

This chenille woven or knitted fabric has a very smooth surface touch and a silk-like high-grade luster. Since almost no raised fine fibers are removed, this fabric is excellent in durability.

9 Claims, 11 Drawing Figures

CHENILLE WOVEN OR KNITTED FABRIC AND PROCESS FOR PRODUCING THE SAME

BACKGROUND OF THE INVENTION

1. Field of the Invention

The present invention relates to an improved chenille woven or knitted fabric provided with a surface which is covered with ultra-fine synthetic fibers having silk-like touch and luster, and a process for the production thereof.

2. Description of the Prior Art

Chenille woven or knitted fabric composed of silk is ranked as one of the higher grades of such fabrics. This fabric is excellent in touch, luster, and other points and, thus, is highly valued as a high-grade clothing material. On the other hand, this fabric is defective in that fibers are removed and worn away during wearing, the fastness to wet rubbing is poor, and shrinkage upon washing is great. Furthermore, this fabric has a defect inherent to natural fibers, that is, a great deviation of properties among fibers. The yield of fiber consumption in the production is therefore very low and, accordingly, the fabric is very expensive.

Chenille woven or knitted fabrics composed of synthetic fibers on the present market are mainly composed of acrylic fibers or a blend of acrylic and cotton fibers. Such a fabric, however, is defective in various points. For example, the surface touch is coarse and hard, the drapability of the fabric as a whole is insufficient, the dimensional change due to shrinkage upon washing is great, and the fabric readily becomes shiny upon ironing.

There has recently been much research carried out to develop a method and apparatus to produce chenille yarn. Such research, however, did not solve the subject matter of how to produce chenille fabric having high quality. Examples of such research are shown in Japanese Unexamined Patent Publication No. 56-63069, which proposes the utilization of a so-called sea-and-island composite filament yarn so as to create very fine raised fibers, Japanese Unexamined Patent Publication No. 53-6642, which discloses an apparatus and method for producing a fancy yarn, and U.S. Pat. No. 3,969,881, which discloses an apparatus for producing chenille yarn. However, as obvious, these prior arts only disclose a method and apparatus for producing chenille yarn.

SUMMARY OF THE INVENTION

We made researches with a view to develop a super-high-grade chenille woven or knitted fabric utilizing synthetic fibers, free of the above defects and having a soft surface touch and genuine silk-like luster and appearance.

In accordance with the present invention, there is provided an improved chenille woven or knitted fabric utilizing synthetic fibers, wherein effect yarns forming a raised fiber portion are composed of ultra-fine fibers having a fineness smaller than 0.9 denier and the rising angle of the fibers longitudinal axis of the effect yarn is not larger than 50°.

DESCRIPTION OF THE PREFERRED EMBODIMENTS

The term "chenille woven or knitted fabric" is hereinafter represented by the term "chenille fabric" to simplify the explanation, except in the explanation of the embodiments of the present invention.

Before explaining in detail the chenille fabric according to the present invention, for the sake of easy understanding, the general structure of chenille yarn and chenille fabric is hereinafter explained with reference to FIG. 1, FIG. 2, and FIG. 3.

Figure 1:
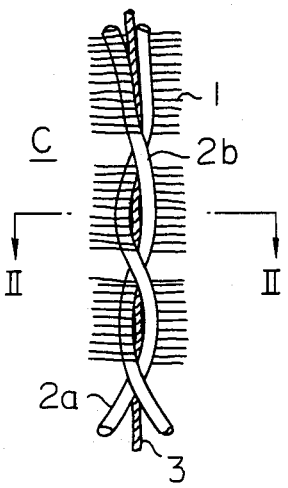
FIG. 1 is an enlarged side view of the chenille yarn for showing the appearance thereof, which is utilized for producing the chenille fabric according to the present invention.
Figure 2:
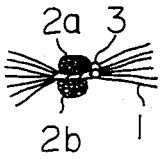
FIG. 2 is an enlarged cross-sectional view of the yarn, taking along the line II—II in FIG. 1.

In FIGS. 1 and 2, showing the appearance and cross-section of known chenille yarn C before aftertreatment, raised fibers 1 are firmly held by twisted core yarns 2*a*, 2*b*, whereby a filament yarn or a spun yarn 3 having a low melting point, which is utilized to fuse the raised fibers to the core yarns 2*a*, 2*b*, is also held. Such chenille yarn can be made by an apparatus as disclosed in U.S. Pat. No. 3,969,881 or an apparatus having a construction and function similar to that of U.S. Pat. No. 3,969,881.

In such an apparatus, an effect yarn formed by the fibers which create the raised fibers are sheared in a predetermined length. The sheared fibers are then trapped at their middle portion by the two core yarns 2*a*, 2*b*, which are twisted with each other so that the sheared fibers held by these core yarns 2*a*, 2*b* become the raised fibers of a chenille yarn C.

If a filament yarn or spun yarn which is capable of fusing by heat treatment by later processing is supplied to the apparatus together with one of the core yarns in a doubled condition, the sheared fibers can be firmly held by the core yarns.

Chenille yarn can also be made by the following method. That is, a plain weave fabric is made by utilizing the core yarn as a warp yarn and the effect yarn as a weft yarn. Tapes are made by cutting the fabric along the warp yarn at each position between two adjacent warp yarns. Then, two tapes are doubled and twisted. However, such a method is inferior to the above apparatus method in view of production efficiency and cost.

Figure 3:
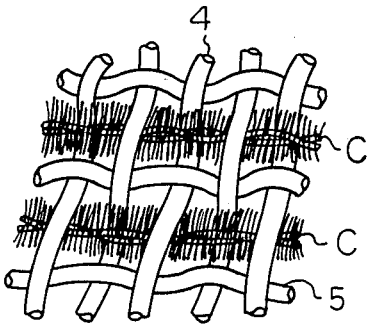
FIG. 3 is a perspective view of an embodiment of chenille fabric, represented as a model of chenille fabric utilizing a chenille yarn like the yarn of FIG. 1.

In an example of a chenille fabric shown in FIG. 3, the fabric is formed by utilizing a ground warp yarn 4, a chenille yarn C, and a ground weft yarn 5, which are alternately picked in the condition before an after-finishing process. In this example, a plain weave structure is utilized as a ground fabric. However, the other weave structure, such as twill weave, is preferably used so as to more densely cover the fabric surface by the raised fibers.

To create the chenille fabric according to the present invention, research involving repeated experiments, described in the examples, was conducted. The overall results of this research are explained below before the description of the examples.

To obtain a chenille yarn having a pliable feel and a soft surface touch, the effect yarn forming the raised fiber portion of the chenille yarn must be a spun yarn or filamentary yarn composed of fibers having a fineness smaller than 0.9 denier, preferably 0.7 to 0.01 denier, especially preferably 0.5 to 0.1 denier. If an effect yarn composed of fibers having fineness larger than 0.9 denier is used, the chenille yarn per se becomes hard and the surface of the chenille fabric becomes rough, coarse, and hard. Furthermore, if the fineness of fibers forming the effect yarn is too large, the crushing treatment for pressing the surface of the raised fibers of the chenille yarn to attain the fiber-rising angle specified in the present invention cannot smoothly be performed. If the fineness of the fibers forming the effect yarn is smaller than 0.01 denier, effective separation of raised fibers of the chenille yarn cannot be created, the processability is degraded, the raised fibers of the chenille yarn are easily entangled with each other, and a dense color may not easily be obtained by dyeing. Accordingly, it is preferred that the fineness of the effect yarn be not smaller than 0.01 denier.

It is preferred that the shear length of the effect yarn be 0.5 to 7 mm, especially 1 to 5 mm. If the shear length of the above-mentioned effect yarn is too long, raised fibers of the chenille yarn often tangle with one another, and the surface condition is often degraded. If the shear length of the effect yarn is too short, the core yarn is often visible through the sheared fibers held by the core yarns from the outside, merits by the use of the chenille yarn in the hand and luster are lost, and the treatment for pressing down the raised fibers of the fabric, described hereinafter, becomes difficult.

A known method and apparatus, such as shown in the U.S. Pat. No. 3,969,881, can be used for the production of the chenille yarn of the present invention. In the production of the chenille yarn, if ultra-fine fibers having a fineness smaller than 0.9 denier are used for producing the core yarn of the chenille yarn, the force for holding fine fibers by the core yarn is further increased, a soft woven or knitted fabric, in which fine raised fibers are firmly held, can be produced, and the unique silk-like luster and a soft surface touch of the chenille fabric according to the present invention can be enhanced.

If ultra-fine fibers having a fineness smaller than 0.9 denier are used for making the ground yarn for the production of a chenille woven or knitted fabric, the back face of the resulting fabric also becomes soft and smooth, and the effects of the present invention are enhanced.

In the present invention, synthetic fibers are preferably utilized to produce the chenille fabric. Any textile materials capable of being formed into ultra-fine fibers can be used. For example, there can be mentioned polyethylene terephthalate, copolymers thereof (comprising 5-sodium sulfoisophthalate or the like as the comonomer component), polybutylene terephthalate, copolymers thereof, nylon 6, nylon 66, nylon 12, polyacrylonitrile type polymers, and regenerated celluloses. These textile materials may advantageously be used according to the intended application of the fabric. Moreover, modifiers or additives for attaining anti-static, dyeability-improving, delustering, stain-proofing, flame-retardant, and shrinkage-preventing effects are preferably incorporated in the foregoing materials.

Figure 4:
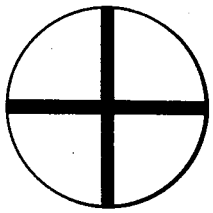
FIG. 4 to FIG. 9 are cross-sectional drawings representing preferred embodiments of a composite filament yarn for producing the chenille fabric according to the present invention.
Figure 5:
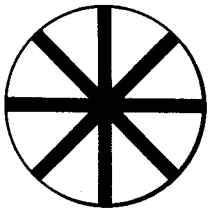
Figure 6:
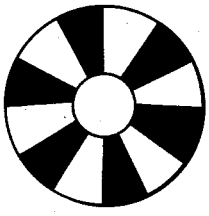
Figure 7:
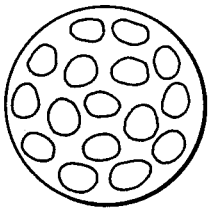
Figure 8:
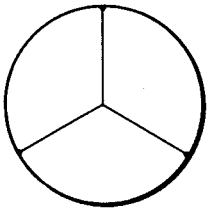
Figure 9:
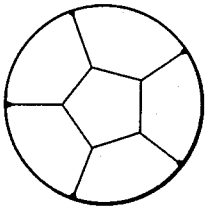

The process for the production of ultra-fine fibers is not particularly critical. For example, any known processes for obtaining ultra-fine fibers from ultra-fine fiber-forming fiber may be used, more specifically, processes for removing one component from multicomponent fibers, for example, island-in-sea type composite fibers or mix-spun fibers, for obtaining ultra-fine fibers by chemically or physically treating split-type fibers, or for obtaining ultra-fine fibers by direct spinning. Sections of composite fibers preferably used in the present invention are diagrammatically shown in FIGS. 4 through 9. Namely, FIGS. 4 through 6 show the sections of split-type composite fibers and FIGS. 7 through 9 show the sections of island-in-sea type composite fibers.

It is preferred that at least 70% of fibers used for the effect yarn have a section of a polygonal shape, especially a triangular to octagonal shape. If at least 70% of fibers forming the effect yarn have a polygonal section, there can be obtained a chenille fabric having a smooth surface touch and a unique luster, in which almost no raised fibers are removed. Accordingly, if such effect yarns are used in the present invention, the effects of the present invention are further enhanced. Moreover, use of these polygonal section fibers for forming the effect yarns allows filling the chenille yarn with the raised fibers so densely that a preferred condition of raised fibers with the density of at least 7000 raised fibers per cm, described hereinafter, can be attained. As a result, the effect of preventing removal of raised fibers from the chenille yarn is enhanced. In the chenille yarn of the present invention, it is preferred that the raised fiber density be at least 7000 fibers/cm, especially at least 10,000 fibers/cm. A chenille yarn having the density of raised fibers within the above-mentioned range is especially excellent in the surface touch and feel of the chenille fabric.

For the production of a chenille yarn having, preferably, raised fibers forming an effect yarn, having a density of at least 7000 fibers/cm, especially at least 10000 fibers/cm, various methods may be adopted. For example, there may be adopted a method for increasing the filling density by using polygonal section fibers as described above, a method for increasing the raised fibers density of the effect yarn at the stage of making a chenille yarn by increasing the pick density of wefts forming effect yarns in case of forming a chenille yarn by cutting a woven fabric in the warp direction or by increasing the feed rate of effect yarn in case of forming a chenille yarn by using a known chenille yarn-producing apparatus, and a method using ultra-fine fibers or ultra-fine fiber-forming fibers to create the chenille yarn. Any one of the foregoing methods can be adopted, or two or more of the foregoing methods may be used in combination. A method using ultra-fine fibers having a polygonal section or ultra-fine fiber-forming fibers is particularly preferred.

In the present invention, a woven or knitted fabric is formed by using the above-mentioned chenille yarn. The weave or knit texture can be chosen appropriately. For example, in order to emphasize the fancy effect of the chenille yarn, a texture such that many raised fibers of the chenille yarn are caused to appear on the surface of the woven or knitted fabric is preferred. In the case of a woven fabric, a weft-backed weave or a backed weave is preferred. In the case of a knitted fabric, a tricot satin texture is preferred. Furthermore, knitting by utilizing the chenille yarn with other yarn is preferred. Moreover, a chenille fabric having the effect of raised fibers of the chenille yarn on both the surfaces thereof, which is obtained by forming a single weave or single knitted cloth with the use of a doubled yarn without twist formed by doubling a chenille yarn and a ground yarn, is preferred. Still further, a chenille fabric formed by using chenille yarns as all the constituent yarns of the fabric may be used.

According to the present invention, a chenille fabric having the above-mentioned weave or knit texture is formed by using a chenille yarn having the above-mentioned structure. As the effect yarn and core yarn for making a chenille yarn and the ground yarn for forming the ground weave, there are preferably used filamentary yarns or spun yarns composed of the same material. However, the yarn material or yarn form is not particularly critical.

The chenille fabric of the present invention may optionally be subjected to ordinary woven or knitted fabric processing treatments such as relax scouring treatment, shrinking treatment, setting treatment, and dyeing treatment according to the intended use. When ultra-fine fiber-forming fibers are used as the material for making a chenille yarns, it is necessary to perform the ultra-fine fiber-forming treatment. The order, procedures, and conditions of these finishing treatments can be chosen appropriately.

Known finishing agents may optionally be applied to the chenille fabric of the present invention. For example, an antistatic agent, a smoothening agent, a softening agent, and other finishing agents may be used according to need.

When ultra-fine fiber-forming fibers are used for making a chenille yarn, the ultra-fine fiber-forming treatment should be carried out. For this purpose, there may be adopted a method in which one component is removed from island-in-sea type composite fibers or mix-spun fibers (for example, in the case where the sea component is composed of polystyrene, the sea component is dissolved out and removed by using trichloroethylene as the solvent for the sea component, while changing the removing liquid several times) and a method in which split-type composite fibers comprising pluralities of non-adhesive polymer filaments mutually interposed are chemically or physically split into ultra-fine fibers (for example, in the case of fibers comprising polyester and polyamide components, splitting is effected by using a swelling agent or the like or by physical means such as rubbing or beating). Needless to say, when ultra-fine fibers are obtained by the direct spinning process, the above-mentioned ultra-fine fiber-forming treatment need not be carried out. In view of processability or the like, it is preferred in the present invention that ultra-fine fiber-forming composite fibers be used and that they be subjected to the ultra-fine fiber-forming treatment.

According to repeated experimental tests, it was found that, in the present invention, it is indispensable that the angle between the axis of the raised fibers and longitudinal axis of the chenille yarn, that is, the rising angle, should be not larger than 50°, preferably 50° to 15°. If the rising angle is larger than 50°, the luster is insufficient or the contrast between the portion of raised fibers of the chenille fabric and the other portion becomes too strong and a harmonious appearance of the chenille fabric is not obtained. Also the rising state of fine fibers of the chenille yarn is unstable and the surface grade is easily reduced. Moreover, the surface of the sewed portion becomes too shiny by ironing. If the rising angle of fine fibers of the chenille yarn is smaller than 15°, the surface becomes flat and has a strong metal-like luster, i.e., a silk-like mild luster cannot be obtained, the product is poor in softness, and a dense color may not easily be obtained at the dyeing step.

Figure 10:
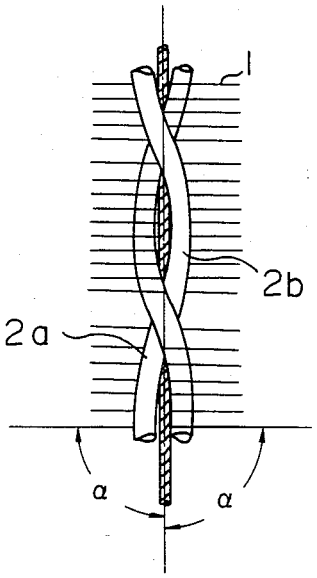
FIG. 10 and FIG. 11 are enlarged side views of the chenille fabric according to the present invention, for indicating the structural relation between the core-yarn and raised fibers of the fancy yarn which are elements of the chenille yarn, respectively.
Figure 11:
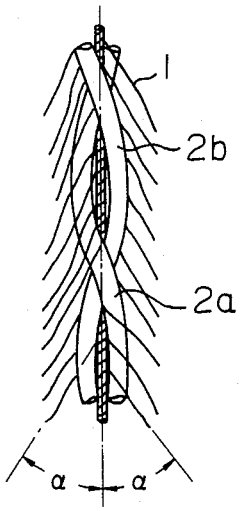

Referring to FIGS. 10 and 11, "rising angle" means the angle $\alpha$ formed between the axis of the raised fibers 1 and the longitudinal axis of the chenille yarn wherein core yarns 2*a* and 2*b* hold the fine fibers 1. The rising angle of the fibers 1 can easily be measured by taking out the chenille yarn from the chenille fabric and measuring the rising angle from an enlarged photograph or under a magnifier.

In conventional chenille fabrics composed of synthetic fibers, in order to obtain the deep color such as seen in velvet, after the dyeing treatment, finishing treatment such as brushing is carried out so that fine fibers, which are made from the effect yarn, of the chenille yarn are raised as vertically $\alpha$ (90°) to the core yarns as possible. In the present invention, a finishing treatment quite different from the finishing treatment adopted for conventional chenille fabrics, that is, a surface-pressing treatment, is carried out. Thus, an improved chenille fabric, not attainable by conventional techniques, which is excellent in the stability of the raised fibers, luster, and the feel and touch, can be obtained.

The means for the surface-pressing treatment and the degree of this treatment may be appropriately determined according to the intended application of the fabric. For example, there is preferably adopted a method in which the chenille fabric is passed between hard rubber mangle rolls, steel mangle rolls, combinations of these rolls, embossing rolls, or crepe rolls under a nip pressure of 0.5 to 7 kg/cm$^2$, preferably 1 to 3 kg/cm$^2$, though the applicable method is not limited thereto. In short, in the present invention, any surface-pressing treatment method may be adopted, as long as the rising angle of the fine fibers, which is made from the effect yarn, to the longitudinal axis of the chenille yarn is not larger than 50°.

It is preferred that the surface-pressing treatment be carried out while the fabric to be treated is in the wet state rather than in the dry state, because the raised fibers of the chenille yarn can then be readily pressed down and a high processing ability is created. According to a preferred embodiment of the present invention, the chenille fabric is dipped in a treating solution containing an antistatic agent, stain-proofing agent, flame retardant, or other finishing agent, then is passed between mangle rolls to remove the solution. According to this embodiment, the surface-pressing treatment and the finishing agent-applying treatment can simultaneously be accomplished.

In order to obtain the above-mentioned chenille fabric of the present invention, the heat treatment, the ultra-fine fiber-forming treatment and the surface-pressing treatment are carried out. The order of these treatments is not particularly critical, and the heat treatment and the ultra-fine fiber-forming treatment may simultaneously be carried out. The following two orders may be considered:

(a) ultra-fine fiber-forming treatment→heat treatment→surface-pressing treatment (b) surface-pressing treatment→heat treatment→ultra-fine fiber-forming treatment If it is desired to obtain a high surface-pressing effect or if dyeing is carried out before the surface-pressing treatment, order (a) is preferred.

The heat treatment is preferably carried out at 60° C. to 200° C. in the dry or wet state or by using hot water. In the case where the heat treatment and the ultra-fine fiber-forming treatment are simultaneously carried out, it is preferred that the chenille fabric be treated with a treating solution capable of dissolving or decomposing the polymer not to be formed into ultra-fine fibers. For example, if the component to be formed into ultra-fine fibers is polyethylene terephthalate and the component not to be formed into ultra-fine fibers is an alkali-soluble polyester, the chenille fabric is first treated with hot alkaline water, and the heat treatment and the ultra-fine fiber-forming treatment are simultaneously carried out. By this heat treatment, not only the setting of the shape of the chenille fabric, but also the softening or melting of a low-melting-point fusion yarn ordinarily supplied simultaneously with the core yarn at the step of forming the chenille yarn is accomplished, whereby the root portions of raised fine fibers are connected to the core yarns or ground yarns forming the ground weave of the chenille fabric.

In this case, in view of the processability and the properties of the product, it is preferred that the difference of the softening point or melting point between the component to be formed into ultra-fine fibers and the fusion yarn be at least 15° C., especially at least 25° C. The kind of the low-melting-point fusion yarn acting as an adhesive yarn should appropriately be selected according to the ultra-fine fiber-forming component so as to attain a good adhesion. From the viewpoint of the dyeability, it is preferred that both the fusion yarn and the ultra-fine fiber-forming component be composed of polymers of the same series. Of course, if the fusion yarn is used, it is preferred that the heat treatment be carried out at a temperature higher than the softening point or melting point of the fusion yarn but lower than the softening point of the ultra-fine fiber-forming component.

When the chenille fabric is subjected to the above-mentioned heat treatment, the fusion yarn present in the core yarn portion of the chenille yarn is softened or melted to bond the root portions of raised fine fibers to the core yarn or the ground yarn forming the ground weave of the chenill fabric. As a result, the stability of the raised fine fibers is improved. Also, the pilling resistance and the feel balance between the hands along the weft direction and the warp direction are improved.

In the present invention, it is preferred that raised fine fibers be dyed in different colors. It is especially preferred that the raised fine fibers be fibers from multi-component filament bundles comprising at least two components differing in the dyeability or composed of a blend comprising at least two single-component fibers differing in the dyeability and that the fibers to be dyed in different colors be different in the fineness thereof.

Although conventional chenille yarn dyed in one color only shows a plain shading effect, in the product of the present invention, a complicated, three-dimensional shading effect can be attained synergistically by shaking and fluttering of the raised fibers dyed in at least two different colors and by the cross dyeing effect in the raised fibers forming the rising portion of the chenille yarn. Furthermore, although only a plain surface condition is given to the conventional chenille fabric, a three-dimensional hand is given to the chenille fabric of the present invention. These complicated and delicate aesthetic effects, not attainable by the conventional dyeing means, can advantageously be attained in the present invention.

The dyeing time and dyeing method are not particularly critical. Any fiber dyeing method, yarn dyeing method, and fabric dyeing method can optionally be adopted. Furthermore, the one-bath dyeing method and the multiple-bath dyeing method can appropriately be adopted according to the intended use. For example, if a yarn comprising two kinds of fibers differing in dyeability is dyed according to the yarn dyeing method, there may be adopted a process in which the yarn is wound in the form of a cheese or hank and is dyed in one bath or a plurality of baths with a dyeing solution exerting a cross dyeing effect by using a package dyeing machine or by using a rotary pack type or jet type hank dyeing machine. Of course, the applicable dyeing process is not limited to this dyeing process.

The cross dyeing effect or different color dyeing referred to in the present invention is defined according to the following two states:

(1) When two kinds of colored fibers are measured by a spectrophotometer, the difference between the main wavelengths of the two colored fibers is at least 10 mμ.

(2) The difference between the L values (as measured by a color difference meter) of the two colored fibers is at least 5 even if the difference between the main wavelengths of the two colored fibers is smaller than 10 mμ. The term "L value" as used herein is defined in Japanese Industrial Standard JIS Z 8730-1970 and entitled "Methods For Specification Of Color Differences For Opaque Materials"; copyright 1974.

As the fibers for the raised fibers of the chenille yarn, there can be mentioned disperse dye-dyeable fibers, acid dye-dyeable fibers, basic dye-dyeable fibers, direct dye-dyeable fibers, and reactive dye-dyeable fibers. A plurality of kinds of fibers differing in the dyeability are appropriately combined and used.

As the disperse dye-dyeable fiber-forming polymer, there can be mentioned polyethylene terephthalate, polyoxyethylene benzoate, polybutylene terephthalate, slightly or greatly copolymerized and modified products thereof, blends of these polymers with modifying agents, and polyamides having a hard skeleton.

As the acid dye-dyeable fiber-forming polymer, there can be mentioned terminal $—NH_2$ group-containing polyamides such as nylon 6, nylon 66, and nylon 610.

As the basic dye-dyable fiber-forming polymer, there can typically be mentioned polymers containing $—SO_3M$ groups, especially $—SO_3Na$ groups, and blends thereof. As typical instances, there can be mentioned polyacrylonitrile type copolymers, copolymers of polyethylene terephthalate and polybutylene terephthalate with sodium sulfoisophthalate or the like, and blends thereof.

As the direct dye- or reactive dye-dyeable fiber, there can be mentioned fibers having reactive groups, typically —OH groups. For example, cellulose fibers and polyvinyl alcohol fibers can be mentioned.

Each of the above-mentioned fiber-forming polymers is known. Of course, fiber-forming polymers other than those mentioned above can be used in the present invention. Furthermore, a mixture of at least two kinds of fibers selected from the above-mentioned fibers can be used as the fibers for creating the raised fibers of the chenille yarn.

Various methods can be considered as means for forming such mixture. For instance, the following combinations of fibers comprising two kinds of fibers differing in the dyeability may be mentioned.

According to one embodiment, two kinds of ultra-fine fibers having a fineness smaller than 0.9 denier and differing in the dyeability are prepared. A blended yarn formed by blending or mix-spinning them at an optional ratio is used as the effect yarn for making the chenille yarn according to the present invention. More specifically, island-in-sea type composite fibers comprising a disperse dye-dyeable fiber-forming polymer as the island component and island-in-sea type composite fibers comprising a basic dye-dyeable fiber-forming polymer as the island component are blended or mix-spun. As the former island component polymer, polyethylene terephthalate can be mentioned. As the latter island component polymer, there can be mentioned polyacrylonitrile type copolymers and copolymers of polyethylene terephthalate with 2.4% by weight of sodium sulfoisophthalate. Furthermore, a combination of island-in-sea type composite fibers comprising nylon 6 (acid dye-dyeable fiber-forming polymer) as the island component and with island-in-sea type composite fibers comprising the above-mentioned basic dye-dyeable fiber-forming polymer or disperse dye-dyeable fiber forming polymer as the island component can be considered.

According to another embodiment, island-in-sea type composite fibers which are capable of forming ultra-fine fibers having a fineness smaller than 0.9 denier by dissolving-out of the sea component or by splitting or rubbing and comprise two polymers differing in the dyeability as the island component, that is, so-called three-component island-in-sea type fibers, are used. More specifically, polystyrene is used as the sea component and two polymers selected from the above-mentioned polymers differing in the dyeability are used as the island component. Spinning is carried out by using a three-component composite spinning machine. The sea component is removed, whereby an ultra-fine fiber bundle where ultra-fine fibers differing in the dyeability are present in the mixed state can be obtained. According to this embodiment, the blending ratio or mix-spinning ratio can optionally be adjusted very easily by changing the extrusion amounts of the polymers at the spinning step. Therefore, in this embodiment, two polymers differing in the dyeability are mingled at an optional ratio at the yarn-forming step, and blend spinning or blend weaving need not be performed after the yarn-forming step.

The number of kinds of fiber-forming polymers dyed in different colors is preferably two or three. Since ultra-fine fibers having a fineness smaller than 0.9 denier are used, if four or more kinds of fibers dyed in different colors are employed, the intended cross dyeing effect is reduced, and almost no three-dimensional surface effect or cubic hand of the chenille fabric can be obtained.

It is preferred that the fineness of single fiber for making the raised fibers of the chenille yarn be varied among the components, because the difference of the coloring degree or coloring property becomes conspicuous and a complicated surface effect and cubic hand of the chenille fabric can be attained.

As the method for processing the improved chenille fabric of the present invention, the hot water treatment and rubbing treatment are preferred. For example, at the dyeing step, the treatment is carried out by using a liquid flow type dyeing machine such as a high-pressure liquid flow dyeing machine or a normal-pressure liquid flow dyeing machine. Furthermore, the chenille fabric of the present invention is subjected to the rubbing treatment at the dyeing step. By this treatment, the raised fibers forming the raised fiber portion are loosened, and the entire touch of the chenille fabric is rendered soft and the drapability is improved.

By the term "liquid flow type dyeing machine" is meant a dyeing machine in which a cloth is carried and circulated in a dyeing tank by a running dyeing solution to cause the cloth to impinge against the dyeing solution or bring the cloth into contact with the dyeing solution. When a dyeing machine of this type is used, the characteristic features of the present invention are conspicuously manifested. In other words, when a known liquid circulation type dyeing machine such as a beam dyeing machine or a known cloth moving type dyeing machine such as a jig dyeing machine or a winch dyeing machine is employed, the intended effects of the present invention are insufficient.

More specifically, when a beam dyeing machine or a jig dyeing machine is used, a flat or paper-like fabric is obtained, ultra-fine fibers of the risen fibers of the chenille yarn are not loosened, the touch becomes hard, and the surface grade and luster are reduced. When a winch dyeing machine is used, since a rope-like product is obtained and a rubbing effect is manifested, the touch can be improved to a level close to the desirable level, but rope wrinkles are formed and the uniformity of the surface grade is reduced.

Although there are many liquid flow type dyeing machines, there are preferably used, for example, a Uni-Ace type liquid flow dyeing machine and a circulation type liquid flow dyeing machine.

As is apparent from the foregoing description, according to the present invention, a novel special chenille fabric having many preferable effects and characteristics can be provided. This chenille fabric can advantageously be used not only as the clothing material but also in various fields for production of industrial articles, construction materials, interior decorative articles, sheets, bags, and the like.

The present invention will now be described in detail with reference to the following examples, that by no means limit the scope of the invention.

EXAMPLE 1

An 18S spun yarn was prepared by using the following island-in-sea composite fiber.

Island component: polyethylene terephthalate
Sea component: polystyrene
Fineness of composite fiber: 3.0 denier
Number of island component fibers: 6
Ratio of island component: 80%
Ratio of sea component: 20%
Fineness of island component element fibers: 0.4 denier
Number crimps: 15 crimps per inch
Cut length: 51 mm The above-mentioned spun yarn was used as an effect yarn to form a chenille yarn and a 60 S/2 spun yarn composed of 1.25 d×51 mm polyethlene terephthalate fiber was used as the core yarn. The chenille yarn-forming operation was carried out while simultaneously feeding a 70 d-10 f low-melting-point polyamide yarn with one of the two core yarns to create a chenille yarn having a shear length of the effect yarn of 3 mm for creating raised fibers of the chenille yarn and a thickness of $\frac{1}{3}$ metric count. A conventional apparatus for producing a chenille yarn having the construction and function similar to the apparatus disclosed in the U.S. Pat. No. 3,969,881 was used to produce the above-mentioned chenille yarn.

The chenille yarn was steam-set at 85° C. for 5 minutes to melt the low-melting-point polyamide yarn and temporarily bond the fancy yarn to the core yarn.

A fabric of weft backed weave having a 6-satin weave forming the surface thereof and a plain weave forming the back surface thereof was formed by using this chenille yarn as the front weft and an 80 S/2 spun yarn of 1.25×51 mm polyethylene terephthalate staple as the back weft forming the ground weave and the warp. The warp density was 96 ends per inch and the weft density was 38 picks per inch.

The obtained woven fabric was immersed in trichloroethylene maintained at normal temperature and then squeezed. This immersing and squeezing treatment was repeated 5 times. Thus, removal of the sea component from the island-in-sea composite fibers used for the raised fibers of the chenille yarn, that is, the ultra-fine fiber-forming treatment, was effected. In the so-obtained woven fabric, because of a high plasticity of ultra-fine raised fibers, the raised fibers were aggregated and they adhered closely to the ground weave, and a high-grade feel inherent to a raised fiber yarn product was not attained.

Then, this woven cloth was dry-heat-set at 180° C. for 2 minutes by a pin tenter drier to complete the bonding of the raised fibers to the core yarns in the chenille yarn. Subsequently, the woven fabric was dyed into a blue color (midnight color) with a disperse dye in a Uni-Ace type liquid flow dyeing machine. By this dyeing treatment, the fine fibers of the chenille yarn were raised and loosened so that the ground weave could not be seen through the raised fibers, and the fabric was prominently softened. Then, the surface-pressing treatment and the finishing agent treatment were simultaneously carried out under the following conditions.

| | |
|---|---|
| Finishing agent treatment solution: | |
| 1 g/l of Silstatt 1173 (supplied by Sanyo Kasei Kogyo) | |
| 0.5 g/l of Wetsofter AS (supplied by Ipposha) | |
| Surface-pressing treatment: | |
| Mangle: | hard rubber roller |
| Nip pressure: | 2 kg/cm$^2$ |
| Pick-up quantity: | 144 owf % |
| Treatment procedures: | 2 dips-2 nips |

The treated fabric was naturally dried and was subjected to the finish setting at 150° C. for 2 minutes in a pin tenter drier.

For comparison, a woven cloth was prepared in the same manner as described above except that the surface-pressing treatment was omitted.

Both of the woven fabrics were compared in various points to obtain results shown in Table 1.

TABLE 1

| | Product of Present Invention (Example 1) | Comparative Known Product |
|---|---|---|
| Angle $\alpha$ between axis of the raised fibers and longitudinal axis of the chenille yarn | 26° to 42° | 74° to 86° |

TABLE 1-continued

| | Product of Present Invention (Example 1) | Comparative Known Product |
|---|---|---|
| Surface grade | good | fair (split) |
| Luster | excellent | bad |
| Hand | | |
| Drapability | good | good |
| Stiffness and Spread | good | bad |
| Adaptability to ironing | good | bad |

As will readily be understood from the results shown in Table 1, the product of the present invention had a uniform surface, had an appropriate resiliency and soft touch, and was a silk-like chenille woven fabric excellent in luster. Furthermore, although the rising angle of the raised fibers was small, the raised fibers were sufficiently separated. Therefore, the product of the present invention was excellent in the grade over the fabric before the surface-pressing treatment.

EXAMPLE 2

Five 110 d-10 f FY yarns of fibril type composite fibers shown below were combined to form an effect yarn of the chenille yarn.

Component A: polyethylene terephthalate
Component B: nylon 6
Fineness of composite fiber: 10.8 deniers
Number of fiber elements of component A: 9
Number of fiber elements of component B: 9
Ratio of component A: 50%
Ratio of component B: 50%
Fineness of component element fiber A: 0.6 denier
Fineness of component element fiber B: 0.6 denier Separately, a modified false-twisted yarn of 225 d-108 f polyethylene terephthalate was prepared as the core yarn. A chenille yarn was formed from these effect and core yarns while supplying the same low-melting-point yarns as used in Example 1, by means of the same apparatus as for Example 1.

The shear length of the effect yarn to create raised fibers of the chenille yarn was 3 mm and the thickness of the chenille yarn was $\frac{1}{2}$ metric count.

The chenille yarn was picked as wefts in a 1/5 twill alternately with ground wefts to form a chenille fabric of a weft back weave provided with a ground structure of plain weave wherein the above-mentioned modified false-twisted yarn is used for weft and warp. The warp density and a weft density of the weft back weave were 98 ends per inch and 34 picks per inch respectively.

The obtained woven cloth was subjected to the dipping/hand rubbing/air drying treatment 5 times by using a 20% aqueous emulsion of benzyl alcohol [containing 2.0% of Sanmol BLS (emulsifier supplied by Nikka Kagaku)] maintained at 30° C. to convert the composite fibers of the fancy yarn to ultra-fine fibers. In the obtained cloth, the raised fine fibers of the chenille yarn adhered closely to the ground weave and the ground weave could clearly be seen. The grade and softness were insufficient.

The cloth was subjected to the dyeing treatment in the same manner as described in Example 1 and then to the surface-pressing treatment. A comparative product was formed without performing the surface-pressing treatment. When the surface-pressing treatment was carried out, the angle between the axis of the raised fine fibers and the longitudinal axis of the chenille yarn was 16° to 24° and when the surface-pressing treatment was not carried out, this angle was 66° to 82°.

The obtained woven fabric according to the present invention was excellent in the luster and touch and had a uniform pepper-and-salt surface on which fibers A dyed in blue and fibers B not substantially colored were uniformly dispersed. Furthermore, although the rising angle of the raised fibers is small since they were sufficiently separated to cover the surface of the ground weave, the ground weave could hardly be seen. In the woven fabric which had not been subjected to the surface-pressing treatment, the luster was insufficient and the degree of dispersion of the fibers A and B was low. Bundles of the raised fibers were present on the surface, and the surface grade was very bad.

EXAMPLE 3

A 27S spun yarn was prepared by using the following inland-in-sea composite fiber.

Island component: polyethylene terephthalate copolymerized with 8% by weight of sodium sulfoisophthalate Sea component: polystyrene copolymerized with 22% by weight of 2-ethylhexyl acrylate Fineness of composite fiber: 2.8 deniers Number of fiber elements of island component: 6

Ratio of island component: 90%

Ratio of sea component: 10%

Fineness of island component element fiber: 0.42 denier

Number of crimps: 13 crimps per inch

Cut length: 51 mm

The section of this composite fiber had a polygonal shape as shown in FIG. 9.

An 80 S/2 spun yarn of 1.25 d×51 mm polyethylene terephthalate staple fibers was used as the core yarn of the chenille yarn and the ground yarn forming the ground weave of the woven cloth. This spun yarn was dyed in a blue color in the form of a hank with a disperse dye.

A chenille yarn was formed by using the composite fiber spun yarn as an effect yarn and the dyed spun yarn as core yarns while simultaneously supplying a 70 d-10 f low-melting-point polyamide yarn with one of the two core yarns. The apparatus similar to the apparatus of Example 1 was used to make the chenille yarn. In the obtained chenille yarn, the shear length of the effect yarns was 3.0 mm, and the metric count of the chenille yarn was 2.3.

The chenille yarn was steam-set at 85° C. for 5 minutes to melt the low-melting-point polyamide yarn and temporarily bond the fine raised fibers made from the effect yarn to the core yarns.

A fabric having a structure of a weft-backed weave formed by a 6-satin front weave forming the surface thereof and a plain weave forming the back surface thereof was made by using the obtained chenille yarn as the front weft and the above-mentioned dyed 80 S/2 spun yarn as the back weft forming the ground weave of the fabric and the warp thereof. The warp yarn density was 92 ends per inch and the weft density was 38 picks per inch.

The obtained woven fabric was washed 5 times with trichloroethylene maintained at normal temperature to remove the sea component from the island-in-sea composite fiber used for the effect yarns and convert the composite fiber as effect yarn to a bundle of ultra-fine fibers. The fabric was then dried. The density of the ultra-fine fibers was about 22,000 fibers per cm.

The woven fabric was dry-heat-set at 180° C. for 2 minutes in a pin tenter drier to completely bond the ultra fine fibers to the core yarns in the chenille yarn. Then, the chenille fabric was dyed into a blue color with a cationic dye in a liquid flow dyeing machine. The dyed fabric was subjected to reducing washing and water washing, and the surface-pressing treatment and the antistatic agent- and softening agent-applying treatment were simultaneously carried out. The fabric was then subjected to the finish setting at 150° C. for 2 minutes in a pin tenter drier.

The so-obtained woven fabric had a weight of 330 g/m$^2$. The surface touch was very soft, and the surface had a special silk-like luster inherent to the raised ultra-fine fibers having polygonal section. The feel was pliable and excellent in drapability. Almost no raised fine fibers were removed and the durability of the chenille fabric was excellent. The rising angle of the raised fine fibers to the longitudinal axis of the chenille yarn was 30° to 41°.

EXAMPLE 4

An 18S spun yarn of the following island-in-sea composite fiber was used as an effect yarn to make the chenille yarn.

Island component: polyethylene terephthalate copolymerized with 8% by weight of sodium sulfoisophthalate Sea component: polystyrene copolymerized with 22% by weight of 2-ethylhexyl acrylate Fineness of composite fiber: 3.0 deniers Number of island component fibers: 6

Ratio of island component: 80%

Ratio of sea component: 20%

Fineness of island component element fiber: 0.4 denier

Crimp number: 14±1.5 crimps per inch

Cut length: 44 mm

A 60 S/2 spun yarn of 0.75 d×38 mm polyethylene terephthalate staple fibers was used as the core yarn of the chenille yarn and an 80 S/2 spun yarn of 1.25 d×44 mm polyethylene terephthalate staple fibers was used as the ground yarn for forming a ground structure of the chenille fabric according to the present invention. The spun yarns to be used as the core yarn and ground yarn were dyed in a blue color with a disperse dye.

By using the dyed core yarns and the above-mentioned effect yarn, a chenille yarn was prepared while simultaneously supplying a 70 d-10 f low-melting-point polyamide yarn with one of the two core yarns. The shear length of the effect yarns to create raised fibers of the chenille yarn was 3.0 mm and the metric count of the chenille yarn was 1/2.3.

The chenille yarn was steam-set at 85° C. for 5 minutes to melt the low-melting-point polyamide yarn and temporarily bond the raised fine fibers to the core yarns. A fabric having a weft backed weave formed by a 1/5 twill front weave and a back plain weave was made by using the chenille yarn as the weft and the above-mentioned dyed spun yarn as the warp for forming the ground weave and the back weft, that is, the ground yarn. The warp density was 92 ends per inch and the weft density was 38 picks per inch.

The woven fabric was washed 5 times with trichloroethylene maintained at normal temperature to remove the sea component from the island-in-sea composite fiber used for the sheared fibers made from the effect yarn and convert the composite fiber to a bundle of raised ultra-fine fibers of the chenille yarn of the fabric. The fabric was then dried.

The fabric was dry-heat-set at 180° C. for 2 minutes in a pin tenter drier to completely bond the raised fine fibers to the core yarns. Subsequently, the chenille fabric was dyed in a blue color with a cationic dye in a circulation type liquid flow dyeing machine. The fabric was subjected to the reducing washing and water washing, and an antistatic agent and a softening agent were applied to the fabric. Then, the surface-pressing treatment was carried out by using nip rolls composed of a hard rubber and the fabric was subjected to the finish setting. In the so-obtained woven fabric, the raised fine fibers were abundant and were sufficiently loosened to cover the surface of the fabric. The surface touch of the fabric was very soft. The fabric had a special silk-like luster inherent to raised ultra-fine fibers. The hand was pliable and excellent in the drapability. Almost no raised fine fibers were removed, and the chenille woven fabric was excellent in the durability. The rising angle of the raised fine fibers to the longitudinal axis of the chenille yarn was 25° to 40°.

EXAMPLE 5

A 16S spun yarn composed of the following island-in-sea composite fiber was used as an effect yarn to make the chenille yarn.

Island component: polyethylene terephthalate
Sea component: polystyrene
Fineness of composite fiber: 3.2 deniers
Number of island component fibers: 16
Ratio of island component: 85%
Ratio of sea component: 15%
Fineness of island component element fiber: 0.17 denier
Crimp number: 15 crimps per inch
Cut length: 44 mm An 80 S/2 spun yarn of 0.75 d×38 mm polyethylene terephthalate staple fibers was used as the core yarn of the chenille yarn and the ground yarn forming the ground weave.

A chenille yarn was made by this spun yarn and the above-mentioned effect yarn while simultaneously supplying a 50 d-10 f low-melting-point polyamide yarn with one of the two core yarns by means of an apparatus as in Example 1. The shear length of the effect yarn to create raised fibers of the chenille yarn was 3.0 mm, and the metric count of the chenille yarn was $\frac{1}{3}$.

The chenille yarn was steam-set at 85° C. for 3 minutes to melt the low-melting-point polyamide yarn and temporarily bond the middle portion of the raised fine fibers to the core yarns.

The chenille yarn was doubled with the ground yarn to form a weaving yarn, and a special chenille woven fabric having raised fibers on both the surfaces and a $\frac{1}{2}$ twill weave fabric was formed by using this weaving yarn. The warp density was 90 ends per inch and the weft density was 65 picks per inch.

The obtained woven fabric was washed 5 times with trichloroethylene maintained at normal temperature to remove the sea component of the island-in-sea composite fiber used for the effect yarn and convert the composite fiber to a bundle of ultra-fine fibers. The fabric was then dried.

The woven fabric was dry-heat-set at 180° C. for 2 minutes in a pin tenter drier to completely bond the raised fine fibers to the core yarns in the chenille yarn. Subsequently, the woven fabric was dyed in a rouge color with a disperse dye in a circulation type liquid flow dyeing machine. The dyed fabric was subjected to reducing washing and water washing, a finishing agent was applied to the fabric, and the surface-pressing treatment was carried out by passing the fabric through nip rolls composed of a hard rubber. Then, the fabric was subjected to finish setting at 150° C. for 2 minutes.

Both the surfaces of the obtained woven fabric were covered with very fine raised fibers of the chenille yarn. Both the front and back faces of the fabric had a soft touch and a fine luster inherent to ultra-fine fibers. Furthermore, the drapability was excellent, and, since almost no raised fine fibers were removed, the woven fabric was excellent in durability. In this special chenille woven fabric, the rising angle of the raised fine fibers to the longitudinal axis of the chenille yarn core was 16° to 25°.

EXAMPLE 6

A 245 d-40 f filament yarn composed of the following island-in-sea composite fiber was used as an effect yarn, core yarn, and ground yarn forming the chenille yarn.

Island component: polyethylene terephthalate
Sea component: polystyrene
Ratio of island component: 93%
Ratio of sea component: 7%
Number of island component element fibers: 16
Fineness of island-in-sea composite fiber: 6.125 denier
Fineness of island component element fiber: 0.356 denier A chenille woven fabric having raised fine fibers on both the surfaces was made in the same manner as described in Example 5 except that the above-mentioned filamentary yarn was used and the chenille yarn and ground yarn were doubled to form a weaving yarn.

The unit weight of the woven fabric was 400 g/m$^2$ and the woven fabric had ultra-fine raised fine fibers at a density of about 30000 fibers/cm$^2$ on both the surfaces. The touch was smooth and soft. The fabric had a silk-like luster and was excellent in drapability. Since almost no raised fine fibers were removed, the woven fabric was excellent in the durability. The rising angle of the raised fine fibers to the longitudinal axis of the chenille yarn was 25° to 43°.

EXAMPLE 7

The following two kinds of island-in-sea composite fibers were prepared.

(A)
Island component: polyethylene terephthalate
Sea component: polystyrene
Fineness of island-in-sea composite fiber: 2.8 denier
Number of island component element fibers: 16
Ratio of island component: 70%
Ratio of sea component: 30%
Fineness of island component element fiber: 0.13 denier
Crimp number: 14±1.5 crimps per inch
Cut length: 51 mm (B)
Island component: polyethylene terephthalate copolymerized with 3.8% by weight of sodium sulfoisophthalate
Sea component: polystyrene copolymerized with 22% by weight of 2-ethylhexyl acrylate
Fineness of island-in-sea composite fiber: 3.0 denier Number of island component element fibers: 6
Ratio of island component: 80%
Ratio of sea component: 20%
Fineness of island component element fiber: 0.4 denier
Crimp number: 14±1.5 crimps per inch
Cut length: 51 mm The above-mentioned two kinds of staple fibers were blended at an (A)/(B) weight ratio of ¼ on a scutching machine. Carding, drawing, roving, and spinning were carried out to form a 30S spun yarn to be used as an effect yarn.

Separately, a 30 S/2 spun yarn of 1.25 d×51 mm polyethylene terephthalate was made as the core yarn and ground yarn.

A chenille yarn provided with raised fine fibers, which are created by the effect yarn in the condition of shearing length of 3 mm, and having a metric count of 1/2.5 was formed by using these effect yarn and core yarn. A 50 d-10 f low-melting-point polyamide yarn was used in combination with the core yarn to fuse-bond the fancy yarn to the core yarn by the heat treatment.

In a ground weave structure having a warp density of 88 ends per inch and a weft density of 14 picks per inch, the chenille yarn was picked as the weft at a density of 14 picks per inch alternately with the ground weft to obtain a fabric of weft backed weave.

The obtained woven fabric was dipped in trichloroethylene maintained at 20° C. several times to remove the sea component from the island-in-sea composite fiber. The fabric was then dried.

Then, the fabric was heat-treated at 160° C. for 2 minutes in a pin tenter drier to fix the shape of the fabric and, simultaneously, to melt the low-melting-point yarn and bond the raised fine fibers of the chenille yarn to the core yarns thereof.

The so-obtained fabric was dyed in one bath containing a cationic dye and a disperse dye under the following conditions.

Disperse Dye:
0.32% of Tetrasil Orange 5RL
0.6% of Resoline Blue FBL
0.11% of Kayalon Polyester Rubine BLS
Cationic Dye:
1.5% of Cathilon Yellow CD-RLE
1.5% of Diacryl Red GL-N
2.8% of Cathilon Blue CD-RLH
Assistant:
1.0 cc/l of acetic acid (90%)
0.15 g/l of sodium acetate
3.0 g/l of anhydrous Glauber salt
1.0 g/l of Sumipon TF (supplied by Sumitomo Kagaku)
Bath Ratio:
1:50
Dyeing Temperature and Time:
115° C., 60 minutes After the dyeing treatment, reducing washing was carried out under the following conditions.

Washing Bath:
2.0 g/l of hydrosulfite
1.0 g/l of soda ash
1.0 g/l of Amiradine (supplied by Daiichi Kogyo)
Bath Ratio:
1:50
Treatment Temperature and Time:
70° C., 20 minutes After the reducing washing, the fabric was sufficiently washed with hot water and cold water. Then, the finishing agent-applying treatment and the surface-pressing treatment were simultaneously carried out on the fabric.

In the so-obtained chenille woven fabric, raised fine fibers dyed in a light violet color and raised fine fibers dyed in a dense blue color were appropriately dispersed. The shading effect due to the difference of the falling direction among the raised fibers was synergistically combined with the cross color effect so that a very complicated three-dimensional appearance having a dense and gentle violet hue as a whole is created. Furthermore, the fabric had a silk-like luster, a soft surface touch and a high-grade feel. In this improved chenille woven fabric, the rising angle of the raised fine fibers to the longitudinal axis of the chenille yarn was 15° to 43°.

EXAMPLE 8

A 30S spun yarn of 3 d×51 mm staples of a three-component composite fiber, comprising two island components differing in the dyeability and one sea component, was prepared. The number of island component element fibers was 16. Twelve fibers of the 16 island component element fibers were composed of the island component of the composite fiber A used in Example 7. The remaining four island component element fibers were composed of the island component of the composite fiber B used in Example 7. The sea component was the same as used in Example 7. The island/sea ratio was 70/30 and the fineness of the island component element fiber was 0.13 denier. A woven fabric was prepared in the same manner as described in Example 7 by using the above spun yarn as an effect yarn and the same core yarn and ground yarn as used in Example 7. The woven fabric was processed in the same manner as described in Example 7. The obtained fabric was dyed with a cationic dye under the following conditions to dye the fiber B.

Cationic Dye:
0.65% of Cathilon Yellow CD-RLH 200
6.0% of Diacryl Red GL-N
0.8% of Cathilon Blue CD-RLH
2.0% of Ospion 700 CD (supplied by Tokai Seiyu)
0.5 cc/l of acetic acid (90%)
Bath Ratio:
1:50
Dyeing Temperature and Time:
115° C., 60 minutes After the dyeing treatment, the soaping operation was carried out under the following conditions.

Soaping Bath:
0.5 g/l of Laccol PSK (supplied by Meisei Kagaku)
0.2 cc/l of acetic acid (90%)
Bath Ratio:
1:50
Treatment Temperature and Time:
60° C., 20 minutes Then, the fabric was dyed with a disperse dye under the following conditions to dye the fiber A.

Disperse Dye:
4.5% of Paranil Scarlet 2R
2.2% of Paranil Blue R
1.5% of Paranil Golden Yellow 2G
0.5 g/l of TD-208 (supplied by Sanyo Kasei Kogyo)
0.5 cc/l of acetic acid (90%)
0.15 g/l of sodium acetate Bath Ratio:
1:50
Dyeing Temperature and Time:
115° C., 60 minutes Then, the fabric was subjected to the reducing washing under the following conditions.

Reducing Washing Bath:
2.0 g/l of hydrosulfite
1.0 g/l of soda ash
1.0 g/l of Amiladin D
Bath Ratio:
1:50
Treatment Temperature and Time:
70° C., 20 minutes After the reducing washing, the fabric was sufficiently washed with warm water and cold water. The finishing agent-applying treatment and the surface-pressing treatment were simultaneously carried out, followed by the finish setting.

In the obtained chenille woven fabric, raised fine fibers colored to rouge and raised fine fibers colored to dark brown were mixed together. The surface as a whole was colored in dense brown, and a very complicated three-dimensional color effect was produced. The surface touch was soft, and almost no raised fine fibers were removed. The rising angle of the raised fine fibers to the longitudinal axis of the chenille yarn was 13° to 16°.

EXAMPLE 9

An 18S spun yarn of the following island-in-sea composite fiber was used as an effect yarn.

Island component: polyethylene terephthalate copolymerized with 8% by weight of sodium sulfoisophthalate
Sea component: polystyrene copolymerized with 22% by weight of 2-ethylhexyl acrylate
Fineness of composite fiber: 3.0 denier
Number of island component element fibers: 6
Ratio of island component: 80%
Ratio of sea component: 20%
Fineness of island component element fiber: 0.4 denier
Crimp number: 14±1.5 crimps per inch
Cut length: 44 mm A 60 S/2 spun yarn of 0.75 d>38 mm polyethylene terephthalate staple fibers was used as the core yarn of the chenille yarn, and an 80 S/2 spun yarn of 1.25 d×44 mm polyethylene terephthalate staple fibers was used as the ground yarn of the ground weave structure. The spun yarns to be used as the core yarn and ground yarn were wound in hanks and dyed in a blue color with disperse dye.

A chenille yarn was formed by using the dyed core yarns and the above-mentioned effect yarn while simultaneously supplying a 70d - 10f low-melting-point polyamide yarn with one of the two core yarns. The shear length of the effect yarn was 3.0 mm, and the metric count of the chenille yarn was 1/2.3.

The chenille yarn was steam-set at 85° C. for 5 minutes to melt the low-melting-point polyamide yarn and temporarily bond the raised fine fibers to the core yarns.

The chenille yarn and the ground yarn were doubled to form a knitting yarn. A knitted fabric of a plain stitch structure was made from this knitting yarn by using a flat knitting machine.

The fabric was washed 5 times with trichloroethylene maintained at normal temperature to remove the sea component from the island-in-sea composite fiber used for the effect yarn and convert the composite fiber to a bundle of ultra-fine fibers.

The fabric was dry-heat-set at 180° C. for 2 minutes in a pin tenter drier to completely bond the raised fine fibers to the core yarn. The fabric was then dyed with a cationic dye in a circulation type liquid flow dyeing machine to dye the knitted fabric into a blue color. Then, the fabric was subjected to the reducing washing and water washing, and an antistatic agent and a softening agent were applied to the fabric and the surface-pressing treatment was carried out, followed by the finish setting.

Both the front and back faces of the obtained knitted fabric were covered with very soft raised fine fibers. The drapability was excellent, and the surface had a special luster inherent to ultra-fine fibers. In this chenille knitted fabric having both the surfaces covered with the raised ultra fine fibers, the rising angle of the raised fine fibers to the longitudinal axis of the chenille yarn was 25° to 40°.

We claim:

1. An improved chenille woven or knitted fabric comprising at least a chenille yarn provided with a core portion and an effect portion held by said core portion, said effect portion comprising raised fibers formed by synthetic ultra-fine fibers having a fineness smaller than 0.9 denier, a rising angle $\alpha$ between an axis of a raised fiber and a longitudinal axis of said chenille yarn being not larger than 50°.

2. An improved chenille woven or knitted fabric according to claim 1, wherein at least 70% of said raised fibers have a polygonal cross section, and said raised fibers have a density of at least 7000 fibers/cm and a length from said core portion of the yarn of less than 3.5 mm.

3. An improved chenille woven or knitted fabric according to claim 1 or 2, wherein a core yarn comprising said core portion is formed by fine fibers having a fineness smaller than 0.9 denier.

4. An improved chenille woven or knitted fabric according to claim 1 or 2, wherein said fabric comprises a ground weave holding said chenille yarns said ground weave being composed mainly of ultrafine fibers having a fineness smaller than 0.9 denier.

5. An improved chenille woven or knitted fabric according to claim 1 or 2 wherein raised fibers for making said chenille yarn are dyed in different colors.

6. An improved chenille woven or knitted fabric according to claim 5, wherein said raised fine fibers dyed in different colors are different in fineness.

7. An improved chenille woven or knitted fabric according to claim 1 or 2, wherein said chenille yarn is composed of multicomponent composite fibers comprising at least two components differing in dyeability or a blend of at least two single component fibers ability in dyeability.

8. A process for the production of an improved chenille woven or knitted fabric utilizing at least a chenille yarn composed of synthetic fibers, comprising forming said fabric from a chenille yarn having a core portion and an effect portion held by said core portion wherein said effect portion comprises raised fine fibers forming a raised fiber portion of said chenille yarn and are composed of ultrafine fibers having a fineness smaller than 0.9 denier and a rising angle $\alpha$ between an axis of said raised fine fibers and a longitudinal axis of said chenille yarn of not larger than 50°, dyeing the woven or knitted fabric and subjecting said woven or knitted chenille fabric to a surface pressing treatment, in the wet condition, after said dyeing.

9. A process for dyeing a chenille woven or knitted fabric according to claim 8, further comprising a rubbing treatment of the knitted or woven fabric carried out simultaneously with the dyeing treatment.

* * * * *